US005478251A

United States Patent [19]

Jaklin

[11] Patent Number: 5,478,251

[45] Date of Patent: Dec. 26, 1995

[54] ELECTRICAL CONNECTOR HAVING IMPROVED SLIDING CAM

[75] Inventor: Ralf Jaklin, Liederbach, Germany

[73] Assignee: The Whitaker Corporation, Wilmington, Del.

[21] Appl. No.: 236,730

[22] Filed: May 2, 1994

[30] Foreign Application Priority Data

Jun. 17, 1993 [GB] United Kingdom ..... 9312513

[51] Int. Cl.[6] ..... H01R 13/62

[52] U.S. Cl. ..... 439/157; 439/347

[58] Field of Search ..... 439/341, 347, 439/452–160

[56] References Cited

U.S. PATENT DOCUMENTS 4,586,771 5/1986 Kraemer et al. ..... 339/75
5,169,327 12/1992 Hatagishi ..... 439/157
5,205,753 4/1993 Butterfield et al. ..... 439/157
5,244,400 9/1993 Hatagishi ..... 437/157

FOREIGN PATENT DOCUMENTS

3645179C2 9/1986 Germany .

*Primary Examiner*—David L. Pirlot
*Attorney, Agent, or Firm*—Eric J. Groen; Driscoll A. Nina; Adrian J. LaRue

[57] ABSTRACT

An electrical connector assembly is shown having matable connectors. One of the connectors has a sliding latch which can be moved transversely to cooperate with lugs on another of the connectors. The lugs have camming surfaces which cooperate with entry portions of camming grooves which cams the sliding latch to a preliminary position, whereby shoulders on the lugs can rest on shoulders within the entry portions.

15 Claims, 4 Drawing Sheets

ELECTRICAL CONNECTOR HAVING IMPROVED SLIDING CAM

BACKGROUND OF THE INVENTION

1. Field of the Invention

The subject invention relates to an electrical connector having a sliding cam which is laterally moveable to bring two electrical connectors into electrical engagement.

2. Description of the Prior Art

In many applications, for example in automotive applications, the amount of space available for placing electrical connectors into position for engagement with the mating connector is quite limited, due to, for example having to place the connector through a door, or through the door pillar, to make engagement with the corresponding connector. On the one hand, it is desirable to have a latching structure which has a mechanical advantage feature, allowing the application of a small force to the latch structure itself, with the application of a large force between the mating connectors to accommodate a full engagement.

One such connector is known from German Patent 36 45 179, where a sliding latch is moveable transversely of the mating direction and includes latching grooves which are angled relative to a length of the sliding latch. The grooves receive latching lugs on the mating connector which, when the sliding latch is moved relative to the one connector housing, with the lugs of the other connector positioned in the grooves, the two connectors are brought into mating engagement. While this connector system has found wide acceptance in the connector industry, in particular in the automotive application, the connector does require two hands to make the connection, as the connector containing the lugs must be mated with the connector containing the sliding cam, in a polarized manner with the Grooves of the sliding cam, while the other hand activates the sliding cam.

SUMMARY OF THE INVENTION

It is an object of the invention then, to provide a connector system, similar to that above, where the connectors could be mated by using only one hand.

The object of the invention was accomplished by providing means to temporarily hold the two connectors in a partially mated position, with the latching lugs of the one connector, aligned with the grooves of the sliding latch whereby the connectors can be temporarily held in place, and when the connectors are ready for mating, only one hand is necessary to activate the sliding latch, to bring the two connectors into a finally latched position.

In the preferred embodiment of the invention, the means are provided by engaging sections of the lug and sliding latch, which temporarily holds the connectors together.

DETAILED DESCRIPTION OF THE PREFERRED EMBODIMENT

Figure 1:
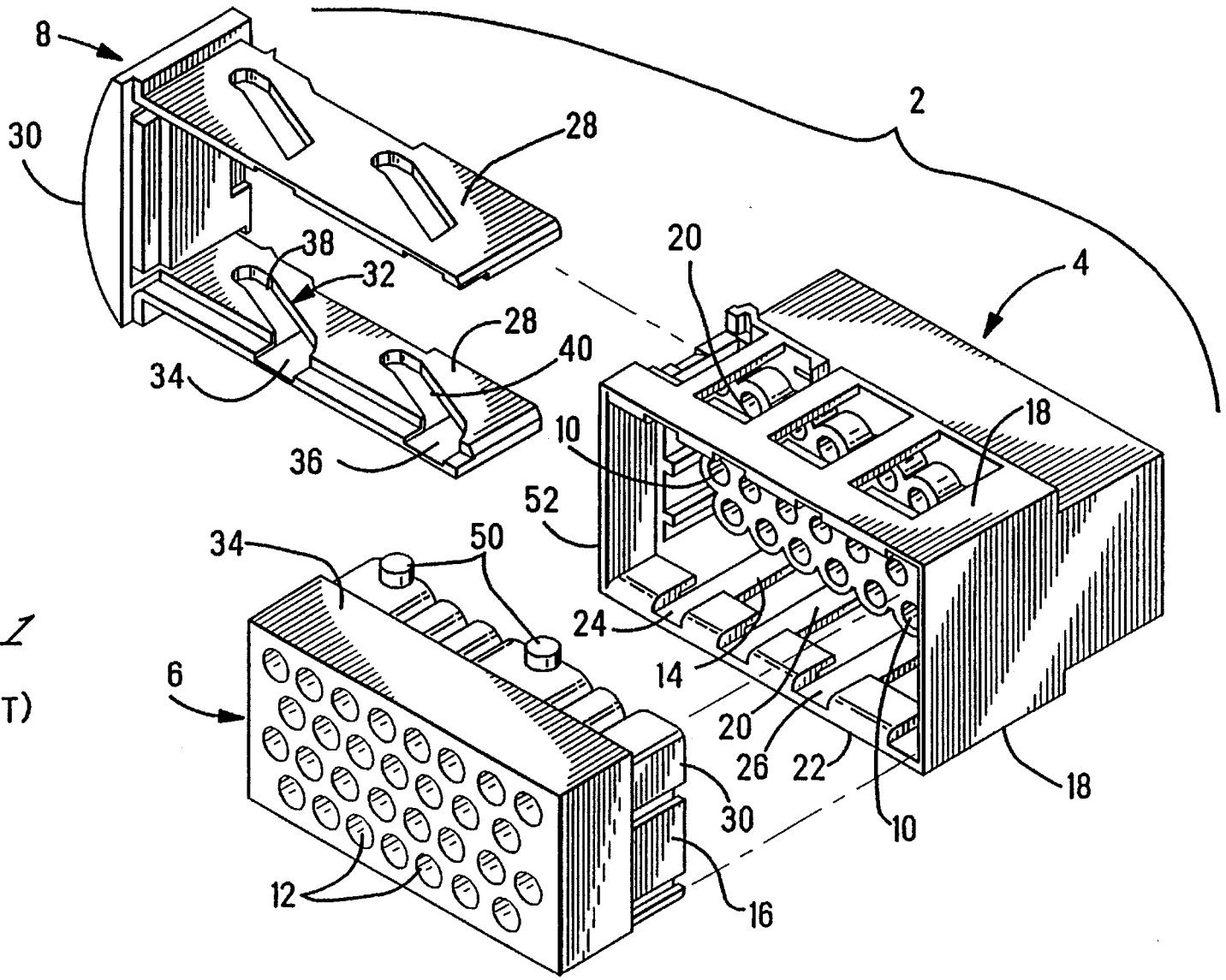
FIG. 1 (PRIOR ART)
FIG. 1 is an isometric view of the prior art connector described above.

With respect first to FIG. 1, the prior art connector will be described for a better understanding of the present invention. The connector assembly is comprised of two connector components, members 2 and 6. Connector 2 is comprised of a receptacle housing 4 and a sliding latch 8. Typically, a plurality of pins are positioned in the apertures 10 of the housing 4, whereas a plurality of socket contacts would be positioned in the apertures 12 of the housing 6. The housing 4 has a cavity 14 which receives a front portion 16 of the connector housing 6. The housing 4 further includes side walls 18 which have channel 20 therein, the channels 20 being profiled to receive arms 28 of the U-shaped slide 8. A front edge 22 of the housing 4, contains axial grooves 24 and 28, which open into the channel 20.

The U-shaped latch member 8 is comprised of the latch arms 26 and an end actuator member 30. The latch member 8 further includes camming grooves 32 comprised of axial entry slots 34 and 36 and angled slot portions 38 and 40. When the latch 8 is positioned within the housing 4, the latch arms 28 are slideably received in the channels 20. When the latch is in the position where the axial grooves 34 and 36 are aligned with the axial grooves 24 and 26 respectively, the connector 2 is in the position where the latching lugs 50 of the connector member 6 may be positioned in the slots 24,34 and 26,36 into the entry portion of the grooves 38 and 40. When in this position, the movement of the actuator portion 30 towards the sidewall 52 of the housing 4, moves the latching lugs 50 into the camming grooves 38, 40, moving the two connectors into full engagement.

Figures 2, 3:
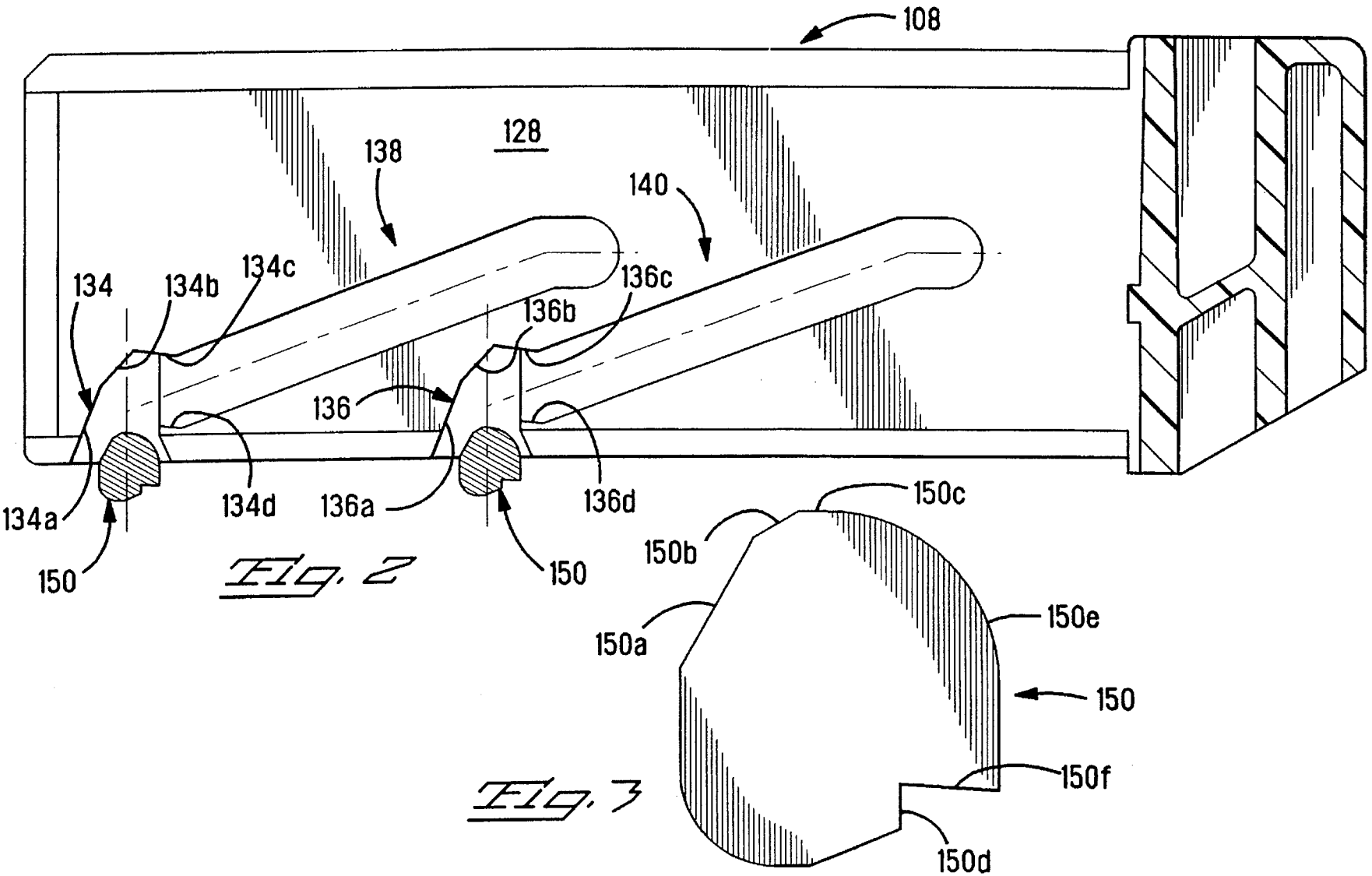
FIG. 2 shows an improved sliding latch useable with the connector assembly of FIG. 1.
FIG. 3 shows an improved latching lug useable with the slide of FIG. 2, and on the connector housing shown in FIG. 1.

With respect now to FIG. 2, an alternate slide is shown as 108, which is replaceable with slide 8 shown in FIG. 1. The slide 108 has arms 128 which have grooves 138 and 140. The grooves 138 and 140 have entry portions 134 and 136, where the entry portions 134, 136 include camming surfaces 134*a*, 134*b*; 136*a*, 136*b*; upper surfaces 134*c*, 136*c*,; and latching surface 134*d*, 136*d*.

With respect now to FIG. 3, the latching lug 150 is shown, which replaces the lug 50 in FIG. 1. The lug 150 has camming surfaces 150*a*, 150*b*; stop surface 150*c*; latch shoulder 150*d*; sliding surface 150*f* and leading surface 150*e*.

Figure 4:
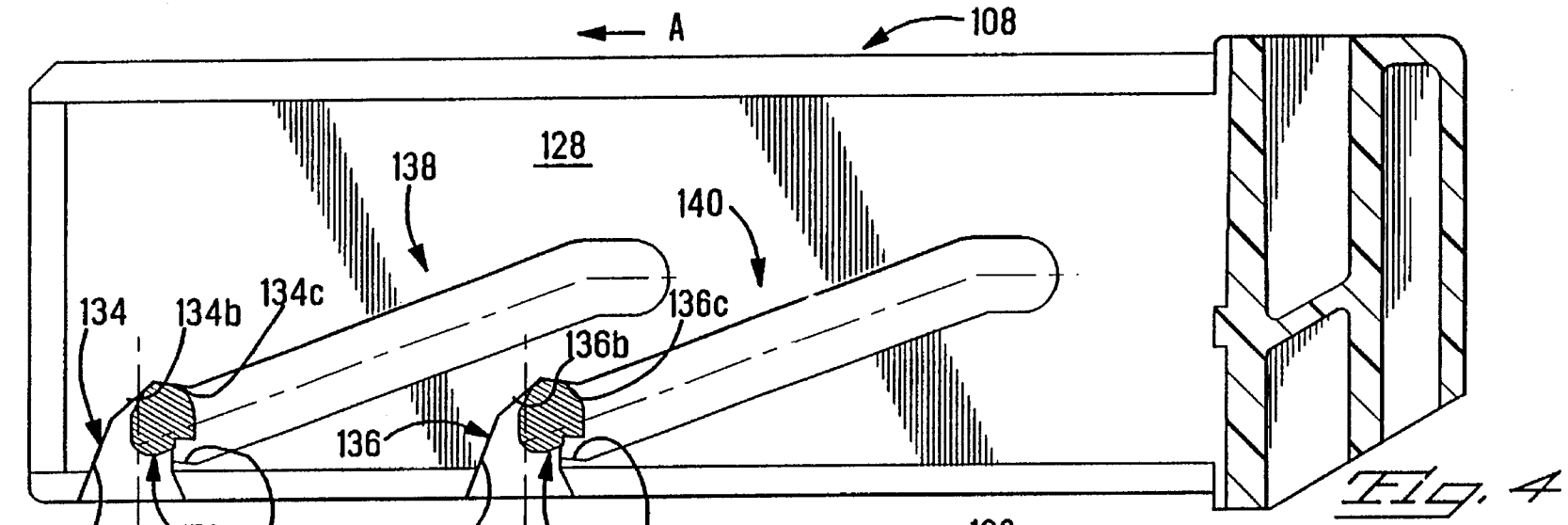
FIG. 4 shows the entry of the two connectors together.

As shown in FIG. 4, the connector 6 containing the latch lug 150 is moved into the entry section 134, such that the camming surfaces 150*a*, 134*a*, 136*a*; and 150*b* 134*b*, 134*c* which moves the sliding latch 108 in the direction of arrow A. Any force on the connector 6, containing the lugs 150, for example, by the weight alone of the connector 6, will bring the shoulder 150*d* into a seated position on the surfaces d, 136*d*.

Figure 5:
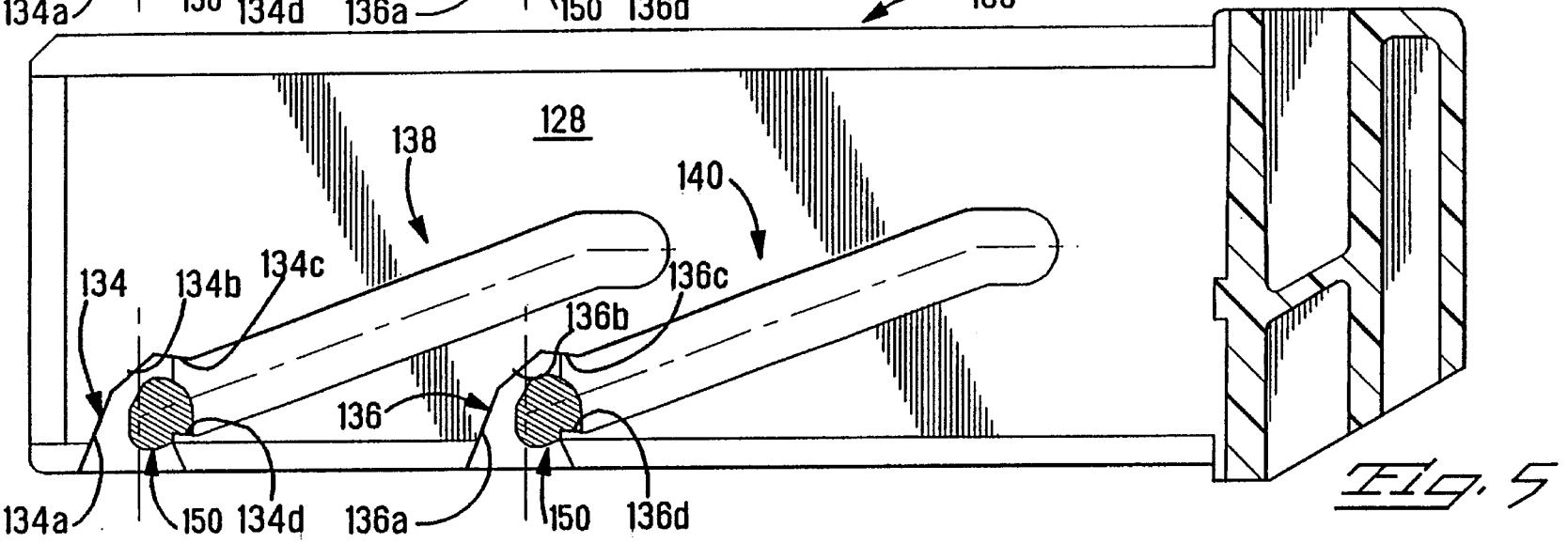
FIG. 5 shows a preliminarily latched position between the two connectors.
Figure 6:
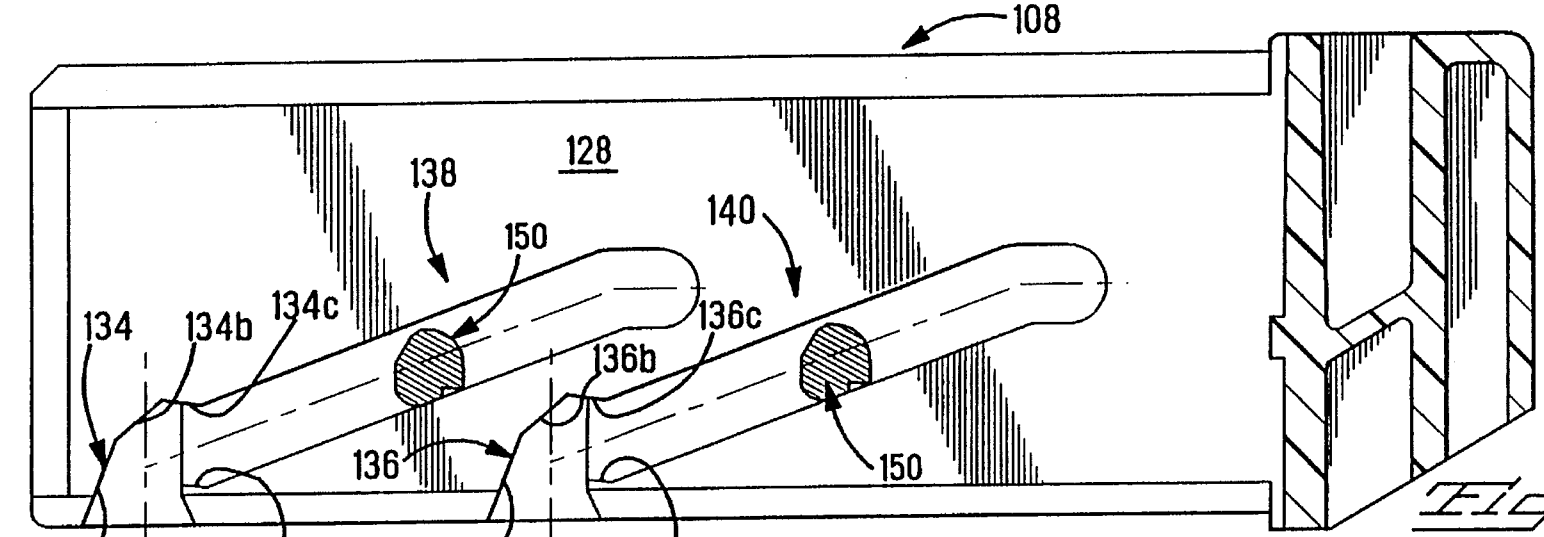
FIGS. 6 and 7 show actuation and fully latched positions of the two connector housings.
Figure 7:
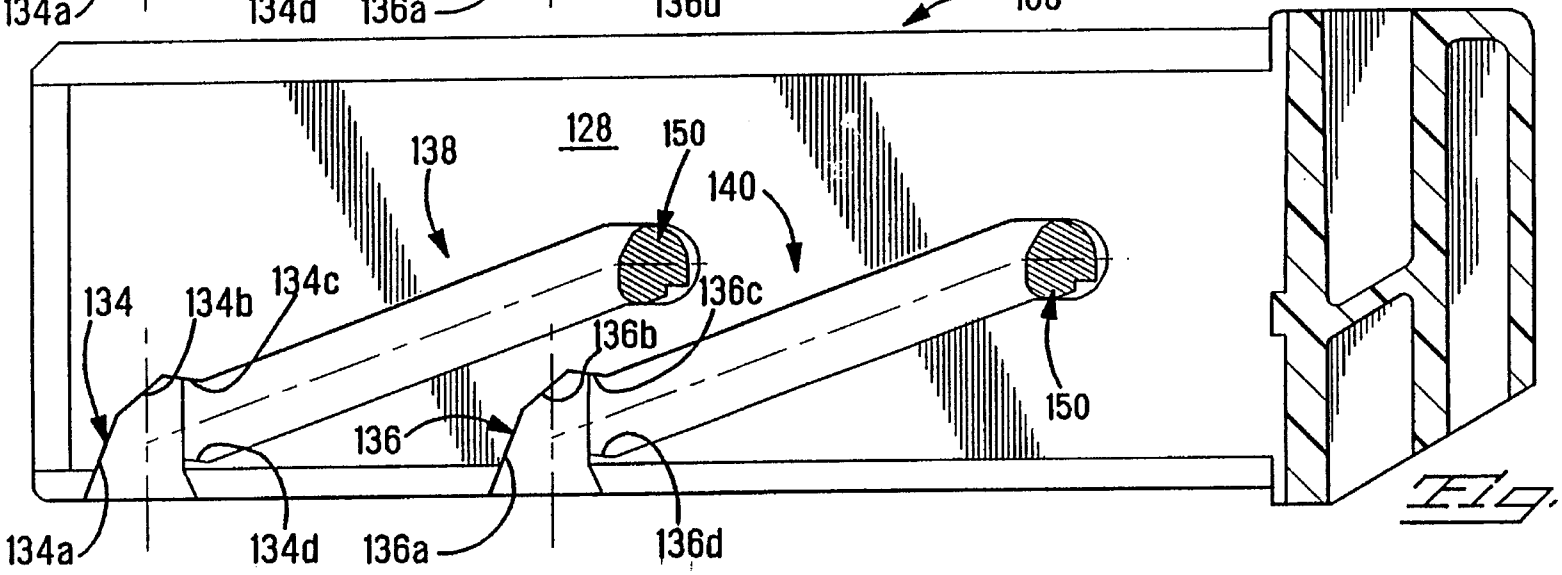

When in the position shown in FIG. 5, the connector 6, no longer has to be held. As shown now in FIGS. 6 and 7, the slide 108, can be moved to the fully lefthand position, bringing the latching lugs into their fully latched

I claim:

1. An electrical connector comprising a housing and a movable sliding latch for interconnection with a mating connector having latching lugs thereupon, the latch having an open position for receiving the latching lugs as the mating connector is joined thereto and a closed position about the lugs when the connectors are fully seated, characterized in that the latching lugs cooperate with the latch as the mating connector is inserted into the housing to displace the sliding latch to a preliminary position, between the open position and the closed position, where the mating connector is captivated to said electrical connector at said preliminary position by interengagement between the latching lugs and the sliding latch thereby preventing the latching lugs from being withdrawn from the sliding latch at said preliminary position.

2. The electrical connector of claim 1, characterized in that the latch includes an entry portion wherein the latching lugs are received when the latch is in the open position, the entry portions having camming surfaces thereupon that cooperate with the latching lugs to displace the latch into the preliminary position.

3. The electrical connector of claim 1, characterized in that the latching lugs include camming surfaces that cooperate with the sliding latch to displace the sliding latch to the preliminary position.

4. The electrical connector of claim claim 1 characterized in that the sliding latch includes a shoulder that engages and prevents the latching lung from being withdrawn from the sliding latch when the latch is in the preliminary position.

5. The electrical connector of claim 1, characterized in that the latching lugs include a shoulder that engages the sliding latch when the latch is in the preliminary position.

6. An electrical connector of claim 1, characterized in that said lugs have a multifaceted configuration.

7. An electrical connector of claim 1, characterized in that the lugs have multifaceted with at least one of the multifaces thereon being a linear surface.

8. A sliding latch for an electrical connector that is interconnectable with a mating connector having latching lugs thereupon, said sliding latch being slidably disposed on a housing of the electrical connector and having camming grooves with entry portions for receiving the latching lugs of the mating connector when the sliding latch is in an open position, where displacement of the sliding latch to a closed position interconnects the electrical connector and the mating connector characterized in that the entry portions include camming surfaces that cooperate with the latching lugs as they are received in the entry portions whereby deflecting the sliding latch to a preliminary position retains the lugs therein thereby maintaining the connectors at the preliminary position which prevents the lugs from withdrawing from the sliding latch.

9. The sliding latch of claim 8, characterized in that the camming grooves include shoulder adjacent to the entry portion and, when the sliding latch is displaced to the preliminary position, the shoulders engage the latching lugs and prevent the latching lugs from being withdrawn from the entry portions, thereby retaining the two connectors together.

10. The sliding latch of claim 6 or claim 9, characterized in that the latching lugs include camming surfaces thereupon that cooperate with the camming surfaces of the entry portion of the sliding latch.

11. The sliding latch of claim 8, characterized in that the latching lugs include shoulders engageable with the sliding latch when the sliding latch is in the preliminary position to prevent the latching lugs from exiting the entry portion of the camming grooves.

12. An electrical connector assembly comprising a first electrical connector and a second electrical connector for mating engagement therebetween;

a slidable latching member mounted on said first connector for movement along said first connector from a first position to a second position, said slidable latching member having camming grooves provided with entry portions;

latching lugs on said second connector for receipt in said entry portions of said camming grooves when said slidable latching member is in said first position; and interengaging portions provided by said latching lugs and said entry portions which become engaged when said slidable latching member is moved to said second position thereby maintaining said second connector at said second position and preventing said latching lugs from being withdrawn from the slidable latching member before the slidable latching member is moved to a third position thereby completely interconnecting the connectors.

13. An electrical connector assembly as claimed in claim 12, wherein the entry portions and the latching lugs have cooperable camming surfaces for displacing the slidable latching member to the second position.

14. An electrical connector assembly of claim 12, wherein said camming surfaces of said entry portions and said latching lugs are multifaceted.

15. An electrical connector assembly of claim 12, wherein the latching lugs have multifaces with at least one of the multifaces being a linear surface.

* * * * *